US005126014A

United States Patent [19]

Chung

[11] Patent Number: 5,126,014

[45] Date of Patent: Jun. 30, 1992

[54] RETENTION AND DRAINAGE AID FOR ALKALINE FINE PAPERMAKING PROCESS

[75] Inventor: Daniel K. Chung, Burlington, Canada

[73] Assignee: Nalco Chemical Company, Naperville, Ill.

[21] Appl. No.: 730,654

[22] Filed: Jul. 16, 1991

[51] Int. Cl.[5] ..... D21H 23/18

[52] U.S. Cl. ..... 162/164.6; 162/168.2; 162/168.3; 162/175; 162/181.6; 162/181.8; 162/183

[58] Field of Search ..... 162/175, 168.3, 181.6, 162/168.2, 181.8, 168.4, 183, 164.6

[56] References Cited

U.S. PATENT DOCUMENTS

| | | | |
|---|---|---|---|
| 4,749,444 | 6/1988 | Lorz et al. | 162/181.8 |
| 4,753,710 | 6/1988 | Langley et al. | 162/164.3 |
| 4,795,531 | 1/1989 | Sofia et al. | 162/181.6 |
| 4,824,523 | 4/1989 | Wagberg et al. | 162/183 |
| 4,892,590 | 1/1990 | Gill et al. | 106/214 |

FOREIGN PATENT DOCUMENTS 0335575 4/1989 European Pat. Off. .

OTHER PUBLICATIONS

R. A. Gill, "The Retention, Drainage and Optical Performance of On-Site Synthesized PCC Fillers," *Pulp & Paper Canada*, 91:9 (1990), pp. 70–74.

*Primary Examiner*—Peter Chin
*Attorney, Agent, or Firm*—Ailes, Ohlandt & Greeley

[57] ABSTRACT

A process in which fine paper is made by forming an aqueous cellulosic suspension comprising fibers, a precipitated calcium carbonate filler and a cationic starch strengthening agent, passing the suspension through one or more shear stages, draining the suspension to form a sheet and drying the sheet. The retention and drainage properties of the suspension are substantially improved via the addition of a cationic coagulant having a molecular weight in the range between about 2,000 to about 500,000 to the suspension prior to any of the shear stages, an anionic flocculant having a molecular weight of at least 500,000 to the suspension after the low molecular weight coagulant but before any of the shear stages, and an inorganic material selected from the group consisting of: bentonite, colloidal silica and other inorganic microparticle materials, to the suspension after at least one of the shear stages.

10 Claims, No Drawings

RETENTION AND DRAINAGE AID FOR ALKALINE FINE PAPERMAKING PROCESS

The present invention relates generally to a unique chemical treatment program which aids in retention and drainage during the production of fine paper from a thick stock which is diluted to form a thin (paper) stock of cellulose fibers, a precipitated calcium carbonate filler and a cationic starch strengthening agent which is passed through one or more shear stages such as cleaning, mixing and pumping stages. The resultant suspension is then drained through a wire to form a sheet of fine paper, which is then dried.

BACKGROUND OF THE INVENTION

Much attention has been paid by the paper industry to chemically pre-treating cellulosic suspensions for the purpose of improving the retention and drainage properties thereof. For example, it is common to include various inorganic materials, such as bentonite and alum, and/or cationic organic materials, such as various natural or modified natural or synthetic polymers, in the thin stock for the purpose of improving the papermaking process. These additives are used for pitch control, decoloration of the drainage water or for facilitating release from drying rolls. Starch is often included to improve strength Process improvements in retention, drainage, drying (or dewatering), and formation (or structure) properties of the final paper sheet are highly coveted. Unfortunately, some of these properties are in conflict with each other. Conventional practice therefore has resulted in the papermaker selecting his additives according to the properties that he judges to be the most important. If, for example, increased filler retention is more important to the papermaker than increased production, then he is more likely to use a cationic polyacrylamide or other very high molecular weight flocculant. If, however, increased production is more important than increased retention, then a coagulant such as aluminium sulfate is more likely to be chosen.

As discussed in U.S. Pat. No. 4,753,710 (Langley et al.), which issued on Jun. 28, 1988, paper stocks may have both an inorganic additive and an organic polymeric material for the purpose of improving retention, drainage, drying and/or formation. For example, a stock may include bentonite, an aluminium sulfate coagulant, and a cationic polymer such as polyethylene imine to improve dewatering. Others have treated paper stock with a filler, a nonionic polyacrylamide, and bentonite. Still others have demonstrated that addition of either a cationic starch or cationic polyacrylamide and bentonite also improves retention. Another process which is believed to result in a suspension having good strength and satisfactory retention includes colloidal silicic acid and cationic starch additives.

In particular, U.S. Pat. No. 4,753,710 provides for the addition of an inorganic material such as bentonite after one of the shear stages, and an organic polymeric material such as a substantially linear, synthetic, cationic polymer (e.g., a cationic polymer flocculant) having a molecular weight above 500,000 and which is added to the suspension before the shear stage in an amount which is at least about 0.03%, based on the dry weight of the suspension. It is also common to include a filler, such as, calcium carbonate, clay, titanium dioxide or talc or a combination, in the cellulosic suspension or paper stock. The filler is preferably incorporated into the stock before addition of the synthetic polymer.

The stock may include other additives such as rosin, alum, neutral sizes or optical brightening agents. It may also include a strengthening agent and this can be a starch, often a cationic starch. The pH of the stock is generally in the range of 4 to 9.

An improvement over U.S. Pat. No. 4,753,710 is disclosed in European Patent Publication No. 0 335 575 (Langley), which was published on Oct. 4, 1989. This patent application was directed primarily to newsprint and board, wherein a low molecular weight cationic polymer, e.g., polyethylene imine, polyamines, polycyandiamide formaldehyde polymers, amphoteric polymers, and polymers of monomers selected from diallyl dimethyl ammonium chloride, diallylaminoalkyl (meth) acrylates and dialkylaminoalkyl (meth) acrylamides, is added to the fiber suspension, followed by addition of a high molecular weight cationic polymer or cationic starch, followed by the addition of bentonite or colloidal silicic acid after the shear stage.

Recently, the papermaking industry has directed its attention to the use of precipitated calcium carbonate and cationic starch as retention aids. It has been discovered that precipitated calcium carbonate-cationic starch systems are useful as efficient binders for improving filler retention, opacity, and strength during papermaking. An example of this is U.S. Pat. No. 4,892,590 (Gill et al.), which issued on Jan. 9, 1990. The Gill patent provides for the addition of 0.13% precipitated calcium carbonate and 1.3% cationic potato starch to a 75:25 hardwood-softwood pulp blend stock containing 20% Albacar 5970 filler pigment which resulted in 89.9% filler retention and 89.0% fiber fines retention. The calcium carbonate component is anionic and colloidal in nature. When used in a papermaking process in the presence of a cationic starch it maximizes filler retention, improves drainage, formation and optical properties while maintaining acceptable strength characteristics in the finished paper.

The present inventor has discovered by extensive experimentation that a chemical treatment program which replaces the high molecular weight cationic flocculant of the cationic coagulant/cationic flocculant-/bentonite program disclosed in European Patent No. 0 335 575 with a high molecular weight anionic flocculant results in a substantial improvement of the retention and drainage properties of the treated fine paper stock. This is particularly true when used in conjunction with cationic starch and precipitated calcium carbonate filler at neutral or alkaline pH. At pH values below 6.8, it has been discovered that cellulosic suspensions which include precipitated calcium carbonate filler become unstable, i.e., acid pH will destabilize the carbonate.

The present invention also provides many additional advantages which shall become apparent as described below.

SUMMARY OF THE INVENTION

A process in which fine paper is made by forming an aqueous cellulosic suspension comprising fibers, a precipitated calcium carbonate filler and a cationic starch strengthening agent, passing the suspension through one or more shear stages, draining the suspension to form a sheet and drying the sheet. The retention and drainage properties of the suspension are substantially improved via the addition of a cationic coagulant having a molecular weight in the range between about 2,000 to about 500,000 to the suspension prior to any of the shear stages, an anionic flocculant having a molecular weight of at least 500,000 and a degree of anionic substitution of at least 0.01 to the suspension after the low molecular weight coagulant but before any of the shear stages, and an inorganic material selected from the group consisting of: bentonite, colloidal silica and any other inorganic microparticle material, to the suspension after at least one of the shear stages.

The filler is preferably precipitated $CaC_{03}$, although other fillers such as clay, titanium dioxide or talc or a combination may also be substituted therefore. The strengthening agent is preferably a cationic starch.

The coagulant has a preferred molecular weight in the range between about 10,000 to about 500,000.

The coagulant is preferably added to a thick stock of the cellulosic suspension and the anionic flocculant is preferably added to a thin stock of the cellulosic suspension. The thin stock is a dilute aqueous suspension of the thick stock. It should be understood, however, that addition of the coagulant and flocculant at any time prior to the shearing stages would be contemplated hereunder.

The cationic coagulant is preferably added to the cellulosic suspension in an amount between about 0.001% to about 0.5%, based on the dry weight of the suspension. The anionic flocculant is preferably added to the cellulosic suspension in an amount between about 0.001 to about 0.8%, based on the dry weight of the suspension.

The coagulant is cationic and selected from the group consisting of: polyethylene imine, polyamines, polycyandiamide formaldehyde polymers, amphoteric polymers, diallyl dimethyl ammonium chloride polymers, diallylaminoalkyl (meth) acrylate polymers, and dialkylaminoalkyl (meth) acrylamide polymers, a copolymer of acrylamide and diallyl dimethyl ammonium chloride, a copolymer of acrylamide and diallyaminoalkyl (meth acrylates, a copolymer of acrylamide and dialkylaminoalkyl (meth) acrylamides, and a polymer of dimethylamine and epichlorohydrin.

The high molecular weight anionic flocculants are selected from the group consisting of: a copolymer of acrylic acid and acrylamide, and a copolymer of acrylamide and acrylamido-2-methyl propyl sulfonate.

The inorganic material is preferably bentonite or a colloidal silica which is added in an amount of from about 0.03 to about 1.0%, based on the dry weight of the suspension.

The pH of the cellulosic suspension is preferably in the range between about 6.8 to about 9.0, especially when calcium carbonate is used as a filler.

Other and further objects, advantages and features of the present invention will be understood by reference to the following specification.

DESCRIPTION OF THE PREFERRED EMBODIMENTS

Paper is made by providing a thick stock, diluting the thick stock to form a thin stock, draining the thin stock to form a sheet and drying the sheet. The thick stock can be made either by mixing water into dried pulp or, in an integrated mill, by diluting a drained pulp. The initial stock can be made from any conventional papermaking stock such as traditional chemical pulps, for instance bleached and unbleached sulfate or sulfite pulp, mechanical pulps such as groundwood, thermomechanical or chemithermomechanical pulp, and any mixtures thereof.

The stock, and the final paper, can be substantially unfilled (e.g., containing less than 10% and generally less than 5% by weight filler in the final paper) or, as is preferred according to the present invention, filler can be provided in an amount of up to 50% based on the dry weight of the stock or up to 40% based on dry weight of paper. It is preferable that precipitated calcium carbonate (PCC) be used as the filler, although it is still possible that any other conventional filler such as clay, titanium dioxide or talc or a combination may be substituted therefore. The filler is typically incorporated into the stock before addition of the synthetic polymer.

The stock may include other additives such as rosin, alum, neutral sizes or optical brightening agents. It also includes a cationic starch strengthening agent.

The amounts of fiber, PCC filler, and cationic starch strengthening agent can all be conventional. Typically, the thin stock has a solids content of 0.2 to 3% or a fiber content of 0.1 to 2%. The stock preferably has a solids content of 0.3 to 1.5 or 2%.

The chemical program of the present invention has been found to be particularly effective in improving the retention and drainage properties of alkaline fine paper stock which includes a precipitated calcium carbonate filler and a cationic starch strengthening agent.

The cationic starch can be derived from any of the commonly available sources of starch producing materials, such as potatoes, corn, wheat and rice. A potato derived starch is favored, especially one in which the degree of substitution is between 0.10% and 0.50%. The preferred cationic potato starch is one made cationic by reaction with 3-chloro-2-hydroxypropyl trimethylammonium chloride to a degree of substitution of from 0.20% to 0.40%.

The ratio of precipitated calcium carbonate to cationic starch ranges from about 2:1 to 1:20. On a dry weight basis, the amount of cationic starch to pulp can vary from about 0.5% to 1.5% dry weight of pulp. The preferred range is 1.0% to 1.5%.

In an actual papermaking operating the precipitated calcium carbonate would be added at the stuff box and the cationic starch would be added before the fan pump. However, total optimization would depend on the approach flow system associated with each specific papermaking machine.

It is standard practice to improve the process performance, or the product quality, by including various retention and drainage additives at various positions along the papermaking process.

The present invention is primarily directed to a process in which alkaline fine paper is made by forming an aqueous cellulosic suspension comprising fibers, precipitated calcium carbonate filler and a cationic starch strengthening agent, passing the suspension through one or more shear stages, draining the suspension to form a sheet and drying the sheet. The retention and drainage properties of such a cellulosic suspension are substantially improved by the addition thereto of a low molecular weight cationic coagulant having a molecular weight in the range between about 2,000 to about 500,000 prior to any of the shear stages, a high molecular weight anionic flocculant having a molecular weight of at least 500,000 and a degree of anionic substitution of at least 0.01 after the low molecular weight cationic coagulant but before any of the shear stages, and an inorganic material of either bentonite or a colloidal silica after at least one of the shear stages.

The shear stages are selected from the group consisting of: a cleaning stage, a mixing stage, and a pumping stage. The cleaning stage is a centriscreen, the pumping stage is a fan pump and the mixing stage is a mixing pump. It is preferable that one or more shear stages comprise a centriscreen, and that the coagulant and anionic flocculant are added to cellulosic suspension before the centriscreen and the inorganic material is added after the centriscreen.

The chemical treatment program according to the present invention (i.e., low molecular weight cationic coagulant-high molecular weight anionic flocculant-bentonite) is particularly effective when the filler is precipitated $CaC_{03}$, the strengthening agent is a cationic starch, and the pH is either neutral or alkaline.

The low molecular weight cationic coagulant preferably has a molecular weight in the range between about 10,000 to about 500,000, more preferably between about 30,000 to about 500,000. And the high molecular weight anionic flocculant preferably has a molecular weight of at least 1,000,000, more preferably of at least 5,000,000.

The inclusion of a high molecular weight anionic coagulant in the thin stock subsequent to the addition o the low molecular weight cationic coagulant to the thick stock and addition of bentonite after one of the shear stages can lead to improvement in the processing and performance properties obtained verses conventional chemical treatment programs using high molecular weight cationic flocculants. This is especially true in the case of paper stock which includes precipitated calcium carbonate fillers and cationic starch.

The low molecular weight cationic coagulant is added to the cellulosic suspension in an amount between about 0.001% to about 0.5%, based on the dry weight of the suspension. The coagulant can be added to a thick stock that is diluted to form a thin stock or it may be added to the thin stock. For instance, generally the thick stock is diluted to form the thin stock by use of white water. It is desirable to add the low molecular weight cationic coagulant before, or immediately after or during, the dilution with white water and to add the high molecular weight anionic flocculant to the thin stock, after the addition of the coagulant. The high molecular weight anionic flocculant is added to the cellulosic suspension in an amount between about 0.001 to about 0.8%, based on the dry weight of the suspension.

The low molecular weight coagulant is cationic and selected from the group consisting of: polyethylene imine, polyamines, polycyandiamide formaldehyde polymers, amphoteric polymers, diallyl dimethyl ammonium chloride polymers, diallylaminoalkyl (meth) acrylate polymers, and dialkylaminoalkyl (meth) acrylamide polymers, a copolymer of acrylamide and diallyl dimethyl ammonium chloride, a copolymer of acrylamide and diallyaminoalkyl (meth) acrylates, a copolymer of acrylamide and dialkylaminoalkyl (meth) acrylamides, and a polymer of dimethylamine and epichlorohydrin.

The low molecular weight cationic coagulant is preferably a polymer of dimethylamine and epichlorohydrin having a molar ratio of 0.85:1 and a molecular weight of about 50,000.

The high molecular weight anionic flocculants are selected from the group consisting of: copolymers of acrylic acid and acrylamide, and copolymers of acrylamide and acrylamido-2-methyl propyl sulfonate. The high molecular weight anionic flocculant is preferably an anionic copolymer of acrylamide and acrylic acid having 30 mole % of acrylic acid.

The inorganic material such as bentonite is added after at least one of the shear stages in an amount of from about 0.03 to about 1%, based on the dry weight of the suspension.

The pH of the cellulosic suspension satisfactorily treatable with the chemical program of the present invention is preferably in the range between about 6.8 to about 9.0 most preferably over 7.2. Any pH below 6.8 will not be applicable because the precipitated calcium carbonate becomes unstable.

The following examples clearly demonstrate that treatment of an alkaline fine cellulosic suspension comprising pulp fibers a precipitated calcium carbonate filler, and a cationic starch strengthening agent with a high molecular weight anionic flocculant, in conjunction with a low molecular weight cationic coagulant and bentonite dramatically improves the retention and drainage properties thereof in comparison to the conventional Hydrocol® program, i.e., a low molecular weight cationic coagulant, a high molecular weight cationic flocculant, and bentonite.

EXAMPLE 1

The data set forth in Tables 1 and 2 below demonstrate microparticle retention after the addition of various chemical treatment programs to a cellulosic suspension, with and without cationic starch. Each program was added to a papermaking furnish having a pH of 7.6, a headbox solids concentration of 0.59%, headbox ash or filler clay concentration of 51.4%, and a starch to ASA (alkenyl succinic anhydride) ratio of 3:1. WW Solids denotes white wash solids, FPR is first pass retention (i.e., better retention aid generates a higher FPR), and FPAR is first pass ash retention.

TABLE 1

(No Cationic Starch Added)

| Chemical Treatment Program | Dosage | WW Solids | FPR | FPAR |
|---|---|---|---|---|
| Blank | | 0.298 | 46.8 | 10.6 |
| [DMA/EPI]-[Acrylamide/Acrylic Acid] | 0.5/1 | 0.191 | 65.9 | 45.2 |
| [DMA/EPI]-[Acrylamide/Acrylic Acid] | 0.5/1.5 | 0.139 | 75.2 | 59.4 |
| [DMA/EPI]-[Acrylamide/Acrylic Acid] | 0.5/2 | 0.150 | 73.2 | 56.1 |
| [DMA/EPI]-[Acrylamide/Acrylic Acid] | 0.5/2.5 | 0.125 | 77.7 | 62.4 |
| [DMA/EPI]-[Acrylamide/Acrylic Acid] | 0.5/3 | 0.144 | 74.3 | 59.4 |
| [DMA/EPI]-[Acrylamide/DMAEA.MCQ] | 0.5/1 | 0.160 | 71.4 | 53.8 |
| [DMA/EPI]-[Acrylamide/DMAEA.MCQ] | 0.5/1.5 | 0.143 | 74.5 | 57.4 |
| [DMA/EPI]-[Acrylamide/DMAEA.MCQ] | 0.5/2 | 0.158 | 71.8 | 55.1 |
| [DMA/EPI]-[Acrylamide/DMAEA.MCQ] | 0.5/2.5 | 0.135 | 75.9 | 60.7 |
| [DMA/EPI]-[Acrylamide/DMAEA.MCQ] | 0.5/3 | 0.113 | 79.8 | 65.3 |
| [DMA/EPI]-[Acrylamide/Acrylic Acid]-[Colloidal Silica] | 0/1/10 | 0.215 | 61.6 | 37.3 |
| [DMA/EPI]-[Acrylamide/Acrylic Acid]-[Colloidal Silica] | 0/2/10 | 0.194 | 65.4 | 42.9 |
| [DMA/EPI]-[Acrylamide/Acrylic Acid]-[Colloidal Silica] | 0.5/2/5 | 0.177 | 68.4 | 49.5 |

TABLE 1-continued (No Cationic Starch Added)

| Chemical Treatment Program | Dosage | WW Solids | FPR | FPAR |
|---|---|---|---|---|
| [DMA/EPI]-[Acrylamide/Acrylic Acid]-[Colloidal Silica] | 0.5/2/10 | 0.180 | 67.9 | 46.9 |
| [DMA/EPI]-[Acrylamide/Acrylic Acid]-[Colloidal Silica] | 0.5/2/15 | 0.191 | 65.9 | 44.5 |
| [DMA/EPI]-[Acrylamide/Acrylic Acid]-[Colloidal Silica] | 0.5/1/5 | 0.218 | 61.1 | 37.3 |
| [DMA/EPI]-[Acrylamide/Acrylic Acid]-[Colloidal Silica] | 0.5/1/10 | 0.185 | 67.0 | 45.5 |
| [DMA/EPI]-[Acrylamide/Acrylic Acid]-[Colloidal Silica] | 0.5/1/15 | 0.170 | 69.6 | 52.1 |
| [DMA/EPI]-[Acrylamide/DMAEA.MCQ]-[Colloidal Silica] | 0/1/10 | 0.175 | 68.8 | 48.5 |
| [DMA/EPI]-[Acrylamide/DMAEA.MCQ]-[Colloidal Silica] | 0/2/10 | 0.147 | 73.8 | 56.4 |
| [DMA/EPI]-[Acrylamide/DMAEA.MCQ]-[Colloidal Silica] | 0.5/2/5 | 0.153 | 72.7 | |
| [DMA/EPI]-[Acrylamide/DMAEA.MCQ]-[Colloidal Silica] | 0.5/2/10 | 0.150 | 73.2 | 55.8 |
| [DMA/EPI]-[Acrylamide/DMAEA.MCQ]-[Colloidal Silica] | 0.5/2/15 | 0.138 | 75.4 | 58.7 |
| [DMA/EPI]-[Acrylamide/DMAEA.MCQ]-[Colloidal Silica] | 0.5/1/5 | 0.202 | 63.9 | |
| [DMA/EPI]-[Acrylamide/DMAEA.MCQ]-[Colloidal Silica] | 0.5/1/10 | 0.174 | 68.9 | 51.8 |
| [DMA/EPI]-[Acrylamide/DMAEA.MCQ]-[Colloidal Silica] | 0.5/1/15 | 0.196 | 65.0 | 42.2 |
| [DMA/EPI]-[Acrylamide/DMAEA.MCQ]-[Bentonite] | 0/1/10 | 0.176 | 68.6 | 47.5 |
| [DMA/EPI]-[Acrylamide/DMAEA.MCQ]-[Bentonite] | 0/2/10 | 0.130 | 76.8 | 60.4 |
| [DMA/EPI]-[Acrylamide/DMAEA.MCQ]-[Bentonite] | 0.5/2/5 | 0.151 | 73.0 | 54.4 |
| [DMA/EPI]-[Acrylamide/DMAEA.MCQ]-[Bentonite] | 0.5/2/10 | 0.153 | 72.7 | 53.8 |
| [DMA/EPI]-[Acrylamide/DMAEA.MCQ]-[Bentonite] | 0.5/2/15 | 0.172 | 69.3 | 50.8 |
| [DMA/EPI]-[Acrylamide/DMAEA.MCQ]-[Bentonite] | 0.5/1/5 | 0.165 | 70.5 | 49.5 |
| [DMA/EPI]-[Acrylamide/DMAEA.MCQ]-[Bentonite] | 0.5/1/10 | 0.196 | 65.0 | 44.2 |
| [DMA/EPI]-[Acrylamide/DMAEA.MCQ]-[Bentonite] | 0.5/1/15 | 0.183 | 67.3 | 48.2 |

Notes:

(1) DMA/EPI is a low molecular weight cationic polymer of dimethylamine and epichlorohydrin having a molar ratio of 0.85:1 and a molecular weight of 50,000.

(2) The acrylamide/acrylic acid copolymer is a high molecular weight anionic flocculant comprising 30 mole % acrylic acid.

(3) The copolymer of acrylamide and dimethylamino ethylacrylate methyl chloride quaternary (DMAEA.MCQ) is a very high molecular weight cationic flocculant having 10 mole % of DMAEA.MCQ.

(4) The collodial silica have small particle size and large surface area.

TABLE 2

(Cationic Starch Added)

| Chemical Treatment Program | Dosage | WW Solids | FPR | FPAR |
|---|---|---|---|---|
| Blank | | 0.258 | 53.9 | 25.7 |
| [DMA/EPI]-[Acrylamide/Acrylic Acid] | 0.5/1 | 0.082 | 85.4 | 60.1 |
| [DMA/EPI]-[Acrylamide/Acrylic Acid] | 0.5/1.5 | 0.105 | 81.3 | 72.3 |
| [DMA/EPI]-[Acrylamide/Acrylic Acid] | 0.5/2 | 0.094 | 83.2 | 74.6 |
| [DMA/EPI]-[Acrylamide/DMAEA.MCQ] | 0.5/1 | 0.181 | 67.7 | 49.5 |
| [DMA/EPI]-[Acrylamide/DMAEA.MCQ] | 0.5/1.5 | 0.183 | 67.3 | 48.2 |
| [DMA/EPI]-[Acrylamide/DMAEA.MCQ] | 0.5/2 | 0.165 | 70.5 | 52.5 |
| [DMA/EPI]-[Acrylamide/Acrylic Acid]-[Colloidal Silica] | 0/1/10 | 0.112 | 80.0 | 69.0 |
| [DMA/EPI]-[Acrylamide/Acrylic Acid]-[Colloidal Silica] | 0/2/10 | 0.084 | 85.0 | 77.9 |
| [DMA/EPI]-[Acrylamide/Acrylic Acid]-[Colloidal Silica] | 0.5/1/5 | 0.107 | 80.9 | 71.3 |
| [DMA/EPI]-[Acrylamide/Acrylic Acid]-[Colloidal Silica] | 0.5/2/10 | 0.089 | 84.1 | 75.9 |
| [DMA/EPI]-[Acrylamide/Acrylic Acid]-[Colloidal Silica] | 0.5/2/5 | 0.127 | 77.3 | 66.0 |
| [DMA/EPI]-[Acrylamide/Acrylic Acid]-[Colloidal Silica] | 0.5/1/10 | 0.116 | 79.3 | 69.0 |
| [DMA/EPI]-[Acrylamide/DMAEA.MCQ]-[Colloidal Silica] | 0/1/10 | 0.144 | 74.3 | 61.1 |
| [DMA/EPI]-[Acrylamide/DMAEA.MCQ]-[Colloidal Silica] | 0/2/10 | 0.141 | 74.8 | 61.4 |
| [DMA/EPI]-[Acrylamide/DMAEA.MCQ]-[Colloidal Silica] | 0.5/2/5 | 0.171 | 69.5 | 51.8 |
| [DMA/EPI]-[Acrylamide/DMAEA.MCQ]-[Colloidal Silica] | 0.5/2/10 | 0.150 | 73.2 | 56.8 |
| [DMA/EPI]-[Acrylamide/DMAEA.MCQ]-[Colloidal Silica] | 0.5/1/5 | 0.171 | 69.5 | 49.5 |
| [DMA/EPI]-[Acrylamide/DMAEA.MCQ]-[Colloidal Silica] | 0.5/1/10 | 0.154 | 72.5 | 54.8 |
| [DMA/EPI]-[Acrylamide/DMAEA.MCQ]-[Bentonite] | 0/1/10 | 0.152 | 72.9 | 57.1 |
| [DMA/EPI]-[Acrylamide/DMAEA.MCQ]-[Bentonite] | 0/2/10 | 0.137 | 75.5 | 61.1 |
| [DMA/EPI]-[Acrylamide/DMAEA.MCQ]-[Bentonite] | 0.5/2/5 | 0.156 | 72.1 | 55.1 |
| [DMA/EPI]-[Acrylamide/DMAEA.MCQ]-[Bentonite] | 0.5/2/10 | 0.137 | 75.5 | 60.7 |
| [DMA/EPI]-[Acrylamide/DMAEA.MCQ]-[Bentonite] | 0.5/1/5 | 0.142 | 74.6 | 59.4 |
| [DMA/EPI]-[Acrylamide/DMAEA.MCQ]-[Bentonite] | 0.5/1/10 | 0.158 | 71.8 | 53.8 |
| [DMA/EPI]-[Acrylamide/Acrylic Acid]-[Bentonite] | 0/1/10 | 0.158 | 71.8 | 56.1 |
| [DMA/EPI]-[Acrylamide/Acrylic Acid]-[Bentonite] | 0/2/10 | 0.132 | 76.4 | 63.0 |
| [DMA/EPI]-[Acrylamide/Acrylic Acid]-[Bentonite] | 0.5/2/5 | 0.110 | 80.4 | 69.6 |
| [DMA/EPI]-[Acrylamide/Acrylic Acid]-[Bentonite] | 0.5/2/10 | 0.089 | 84.1 | 75.9 |
| [DMA/EPI]-[Acrylamide/Acrylic Acid]-[Bentonite] | 0.5/1/5 | 0.109 | 80.5 | 71.0 |
| [DMA/EPI]-[Acrylamide/Acrylic Acid]-[Bentonite] | 0.5/1/10 | 0.131 | 76.6 | 62.4 |
| [DMA/EPI]-[Acrylamide/Acrylic Acid]-[Sodium Silicate] | 0.5/2/10 | 0.104 | 81.4 | 26.4 |
| [Cationic Starch]-[Colloidal Silica] | 5/20 | 0.157 | 72.0 | 56.4 |
| [Cationic Starch]-[Colloidal Silica] | 10/20 | 0.167 | 70.2 | 53.8 |
| [Cationic Starch]-[Colloidal Silica] | 10/30 | 0.167 | 70.2 | 50.5 |
| [DMA/EPI]-[Acrylamide/Acrylic Acid]-[Polyacrylate] | 0.5/2/10 | 0.104 | 81.4 | 26.4 |
| [Cationic Starch]-[Polyaluminium Silicate Sulfate] | 0/1070 | 0.215 | 61.6 | 36.3 |
| [Cationic Starch]-[Polyaluminium Silicate Sulfate] | 10/1070 | 0.242 | 56.8 | 29.7 |

TABLE 2-continued

| Chemical Treatment Program | (Cationic Starch Added) Dosage | WW Solids | FPR | FPAR |
|---|---|---|---|---|
| [Cationic Starch]-[Polyaluminium Silicate Sulfate] | 20/750 | 0.244 | 56.4 | 30.7 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid.
(3) The copolymer of acrylamide and dimethylamino ethylacrylate methyl chloride quaternary (DMAEA.MCQ) is a very high molecular weight cationic flocculant having 10 mole % of DMAEA.MCQ.
(4) The collodial silica have small particle size and large surface area.
(5) The polyacrylate is a very low molecular weight anionic polyacrylate solution polymer.

The best treatment programs were those comprising the addition of a low molecular weight cationic dimethylamine/epichlorohydrin polymer coagulant, a high molecular weight anionic acrylamide/acrylic acid copolymer flocculant, and either bentonite or colloidal silica to a cellulosic suspension comprising a cationic starch. These treatment programs resulted in an FPR of 84.1 and an FPAR of 75.9.

EXAMPLE 2

The data set forth in Tables 3, 4, 5 and 6 below directly compare the effectiveness of high molecular weight cationic flocculant-based treatment programs verses high molecular weight anionic flocculant-based treatment programs. When the anionic flocculant-based treatment programs according to the present invention were added to a cellulosic suspension comprising fibers, a cationic starch and precipitated calcium carbonate, and consistently out performed conventional cationic flocculant-based programs in terms of first pass retention (FPR) and first pass ash retention (FPAR).

The synthetic stock in these experiments had a 0.62% consistency and the ash had a 0.31% consistency. The soluble charge of the stock was +0.06 meq/mL. The sizing agent was added in an amount of 2 lbs./ton, while the starch was added in an amount of 10 lbs./ton. The paper stock had a pH of 7.6. The order of addition was low molecular weight cationic coagulant/cationic starch/sizing agent/flocculant/inorganic microparticle.

TABLE 3

| Chemical Treatment Program | Dosage | Suction Drainage | WW Solids | Ash Wt. | FPAR | FPR |
|---|---|---|---|---|---|---|
| Blank | | 19.7 | 0.188 | 0.1677 | 45.9 | 69.7 |
| [Cationic Starch]-[Sizing] | 10/2 | 31.8 | 0.166 | 0.1438 | 53.6 | 73.2 |
| [DMA/EPI]-[Acrylamide/DMAEA.MCQ]-[Colloidal Silica] | 0.5/1/10 | 16.9 | 0.025 | 0.0187 | 94.0 | 96.0 |
| [DMA/EPI]-[Acrylamide/DMAEA.MCQ]-[Colloidal Silica] | 0.5/2/10 | 26 | 0.031 | 0.0251 | 91.9 | 95.0 |
| [DMA/EPI]-[Acrylamide/DMAEA.MCQ]-[Colloidal Silica] | 1/1/10 | 14.5 | 0.071 | 0.0585 | 81.1 | 88.5 |
| [DMA/EPI]-[Acrylamide/DMAEA.MCQ]-[Colloidal Silica] | 1/2/10 | 23.9 | 0.072 | 0.0599 | 80.7 | 88.4 |
| [DMA/EPI]-[Acrylamide/DMAEA.MCQ]-[Bentonite] | 0.5/1/10 | 20.9 | 0.123 | 0.1063 | 65.7 | 80.2 |
| [DMA/EPI]-[Acrylamide/DMAEA.MCQ]-[Bentonite] | 0.5/2/10 | 47.6 | 0.118 | 0.1027 | 66.9 | 81.0 |
| [DMA/EPI]-[Acrylamide/DMAEA.MCQ]-[Bentonite] | 1/1/10 | 31.5 | 0.135 | 0.1128 | 63.8 | 78.2 |
| [DMA/EPI]-[Acrylamide/DMAEA.MCQ]-[Bentonite] | 1/2/10 | 120 | 0.098 | 0.078 | 74.8 | 84.2 |
| [DMA/EPI]-[Acrylamide/Acrylic Acid*]-[Bentonite] | 0.5/1/10 | 6.6 | 0.064 | 0.0505 | 83.7 | 89.7 |
| [DMA/EPI]-[Acrylamide/Acrylic Acid*]-[Bentonite] | 0.5/2/10 | 4.5 | 0.093 | 0.0758 | 75.5 | 85.0 |
| [DMA/EPI]-[Acrylamide/Acrylic Acid*]-[Bentonite] | 1/1/10 | 5.9 | 0.082 | 0.0645 | 79.2 | 86.8 |
| [DMA/EPI]-[Acrylamide/Acrylic Acid*]-[Bentonite] | 1/2/10 | 5.2 | 0.107 | 0.0835 | 73.1 | 82.7 |
| [DMA/EPI]-[Acrylamide/Acrylic Acid*] Shear | 0.5/1 | 13.3 | 0.183 | 0.1518 | 51.0 | 70.5 |
| [DMA/EPI]-[Acrylamide/Acrylic Acid*] Shear | 0.5/2 | 9.2 | 0.148 | 0.123 | 60.3 | 76.1 |
| [DMA/EPI]-[Acrylamide/Acrylic Acid*] Shear | 1/1 | 16.3 | 0.154 | | | 75.2 |
| [DMA/EPI]-[Acrylamide/Acrylic Acid°] Shear | 1/2 | 12 | 0.195 | | | 68.5 |
| [DMA/EPI]-[Acrylamide/Acrylic Acid°] No Shear | 0.5/1 | 16.9 | 0.096 | | | 84.5 |
| [DMA/EPI]-[Acrylamide/Acrylic Acid*] No Shear | 0.5/2 | 12.4 | 0.062 | | | 90.0 |
| [DMA/EPI]-[Acrylamide/Acrylic Acid*] No Shear | 1/1 | 19.4 | 0.145 | | | 76.6 |
| [DMA/EPI]-[Acrylamide/Acrylic Acid°] No Shear | 1/2 | 14.9 | 0.079 | | | 87.3 |
| [DMA/EPI]-[Acrylamide/Acrylic Acid*]-[Bentonite] w/starch | 0.5/2/10 | 6.3 | 0.134 | | | 78.4 |
| [DMA/EPI]-[Acrylamide/Acrylic Acid*]-[Bentonite] starch 15 lb | 0.5/2/10 | 4.7 | 0.149 | | | 76.0 |
| [DMA/EPI]-[Acrylamide/Acrylic Acid*]-[Bentonite] starch 20 lb | 0.5/2/10 | 9.4 | 0.075 | | | 87.9 |
| [DMA/EPI]-[Acrylamide/Acrylic Acid*]-[Bentonite] starch 20 lb | 0.5/2/15 | 6.7 | 0.083 | | | 86.6 |
| [DMA/EPI]-[Acrylamide/Acrylic Acid*]-[Bentonite] no starch | 0.5/2/10 | >6.3 | 0.206 | | | 66.8 |
| [DMA/EPI]-[Acrylamide/Acrylic Acid*]-[Bentonite] no starch | 0.5/2/10 | 4.9 | 0.193 | | | 68.9 |
| [DMA/EPI]-[Acrylamide/Acrylic Acid*]-[Bentonite] no starch | 0.5/2/10 | 6.3 | 0.215 | | | 65.3 |
| [DMA/EPI]-[Acrylamide/Acrylic Acid*]-[Colloidal Silica] | 0.5/1/10 | 6.2 | 0.115 | | | 81.5 |
| [DMA/EPI]-[Acrylamide/Acrylic Acid°]-[Colloidal Silica] | 0.5/2/10 | 5 | 0.059 | | | 90.5 |
| [DMA/EPI]-[Acrylamide/Acrylic Acid°]-[Colloidal Silica] | 1/1/10 | 5.7 | 0.125 | | | 79.8 |
| [DMA/EPI]-[Acrylamide/Acrylic Acid*]-]Colloidal Silica] | 1/2/10 | 5.1 | 0.145 | | | 76.6 |
| [DMA/EPI]-[Polyacrylamide]-[Bentonite] | 0.5/2/10 | 18.3 | 0.16 | | | 74.2 |
| [DMA/EPI]-[PEO]-[Bentonite] | 0.5/2/10 | 19.8 | 0.162 | | | 73.9 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid. (°denotes a higher molecular weight version of the aforementioned acrylamide/acrylic acid copolymer).
(3) The copolymer of acrylamide and dimethylamino ethylacrylate methyl chloride quaternary (DMAEA.MCQ) is a very high molecular weight cationic flocculant having 10 mole % of DMAEA.MCQ.
(4) The collodial silica have small particle size and large surface area.
(5) The polyacrylamide is a nonionic homopolymer of polyacrylamide.
(6) The PEO is a liquid suspension of nonionic polyethylene oxide.

The aforementioned data demonstrates that chemical treatment programs according to the present invention were not as effective in improving the retention properties of the cellulosic suspension when added without cationic starch.

The data set forth in Tables 4, 5 and 6 below was derived from a paper furnish having the following properties:

| | |
|---|---|
| Solids | 0.47% |
| Headbox Ash | 47.7% |
| pH | 7.4 |
| Furnish Charge | −1.21 mobility units |
| Precipitated $CaCO_3$ | −.69 mobility units |
| Colloid Titration | +0.06 meq/mL |

acrylamide/acrylic acid, and bentonite added in amounts of 0.5/2/10 (lbs. per ton), respectively, to a cellulosic suspension comprising fiber, precipitated calcium carbonate, and cationic starch, produced the highest retention values, i.e., an FPAR of 89.8 and an FPR of 91.1.

Table 5 below sets forth data related to a study of dual polymer programs without shear.

TABLE 5

(CATIONIC STARCH ADDED)

| Chemical Treatment Program | Dosage | Suction Drainage | WW Solids | Ash Wt. | FPAR | FPR |
|---|---|---|---|---|---|---|
| [DMA/EPI]-[Acrylamide/Acrylic Acid*] | 0/2 | 110 | 0.043 | 0.0298 | 73.4 | 81.7 |
| [DMA/EPI]-[Acrylamide/Acrylic Acid*] | 0.25/2 | 170 | 0.063 | 0.0488 | 56.4 | 73.2 |
| [DMA/EPI]-[Acrylamide/DMAEA.MCQ] | 0/2 | 165 | 0.076 | 0.0602 | 46.3 | 67.7 |
| [DMA/EPI]-[Acrylamide/DMAEA.MCQ] | 0.25/2 | 215 | 0.082 | 0.0642 | 42.7 | 65.1 |
| [DMA/EPI]-[Polyacrylamide] | 0/2 | 180 | 0.111 | 0.0918 | 18.0 | 52.8 |
| [DMA/EPI]-[Polyacrylamide] | 0.25/2 | 270 | 0.115 | 0.093 | 17.0 | 51.1 |
| [DMA/EPI]-[PEO] | 0/2 | 350 | 0.087 | 0.066 | 41.1 | 63.0 |
| [DMA/EPI]-[PEO] | 0.25/2 | 380 | 0.107 | 0.0923 | 17.6 | 54.5 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid. (*denotes a higher molecular weight version of the aforementioned acrylamide/acrylic acid copolymer).
(3) The copolymer of acrylamide and dimethylamino ethylacrylate methyl chloride quaternary (DMAEA.MCQ) is a very high molecular weight cationic flocculant having 10 mole % of DMAEA.MCQ.
(4) The Polyacrylamide is a nonionic homopolymer of polyacrylamide.
(5) The PEO is a liquid suspension of a high molecular weight nonionic polyethylene oxide.

The dual polymer program of a cationic polymer of DMA/EPI and an anionic copolymer of acrylamide/acrylic acid produced the best retention values, i.e., FPAR of 56.4 and FPR of 73.2.

The treatment programs set forth in Table 6 below study the effect of starch levels with 2 lbs./ton size at a 3:1 ratio.

TABLE 4

| Chemical Treatment Program | Dosage | Suction Drainage | WW Solids | Ash Wt. | FPAR | FPR |
|---|---|---|---|---|---|---|
| Blank | | 62 | 0.115 | 0.1038 | 7.3 | 51.1 |
| [Cationic Starch]-[Sizing Agent] | 10/2 | 117 | 0.103 | 0.0549 | 51.0 | 56.2 |
| [DMA/EPI]-[Acrylamide/Acrylic Acid*]-[Bentonite] | 0.5/2/10 | 350 | 0.021 | 0.0114 | 89.8 | 91.1 |
| [DMA/EPI]-[Acrylamide/Acrylic Acid*]-[Bentonite] | 0/2/10 | 150 | 0.021 | 0.0118 | 89.5 | 91.1 |
| [DMA/EPI]-[Acrylamide/Acrylic Acid*]-[Bentonite] | 0/2/15 | 56 | 0.058 | 0.0309 | 72.4 | 75.3 |
| [DMA/EPI]-[Acrylamide/Acrylic Acid*]-[Bentonite] | 0/2/20 | 64 | 0.047 | 0.0256 | 77.1 | 80.0 |
| [DMA/EPI]-[Acrylamide/Acrylic Acid*]-[Bentonite] | 0.25/2/20 | 59 | 0.032 | 0.0266 | 76.3 | 86.4 |
| [DMA/EPI]-[Acrylamide/Acrylic Acid*]-[Colloidal Silica] | 0.25/2/20 | 93 | 0.040 | 0.0186 | 83.4 | 83.0 |
| [DMA/EPI]-[Acrylamide/Acrylic Acid*]-[Colloidal Silica] | 0/2/20 | 70 | 0.022 | 0.0185 | 83.5 | 90.6 |
| [DMA/EPI]-[Acrylamide/Acrylic Acid*]-[Colloidal Silica] | 0/2/15 | 64 | 0.035 | 0.0293 | 73.8 | 85.1 |
| [DMA/EPI]-[Acrylamide/DMAEA.MCQ]-[Colloidal Silica] | 0/2/20 | 120 | 0.026 | 0.0239 | 78.7 | 88.9 |
| [DMA/EPI]-[Acrylamide/DMAEA.MCQ]-[Colloidal Silica] | 0/2/15 | 150 | 0.032 | 0.0258 | 77.0 | 86.4 |
| [DMA/EPI]-[Acrylamide/DMAEA.MCQ]-[Bentonite] | 0/2/20 | 240 | 0.049 | 0.026 | 76.8 | 79.1 |
| [DMA/EPI]-[Acrylamide/DMAEA.MCQ]-[Bentonite] | 0/2/15 | 140 | 0.036 | 0.029 | 74.1 | 84.7 |
| [DMA/EPI]-[Polyacrylamide]-[Bentonite] | 0/2/20 | 210 | 0.044 | 0.0429 | 61.7 | 81.3 |
| [DMA/EPI]-[Polyacrylamide]-[Bentonite] | 0/2/15 | 134 | 0.049 | 0.0359 | 67.9 | 79.1 |
| [DMA/EPI]-[PEO]-[Bentonite] | 0/2/20 | 95 | 0.069 | 0.0603 | 46.2 | 70.6 |
| [DMA/EPI]-[PEO]-[Bentonite] | 0/2/15 | | 0.069 | 0.0352 | 68.6 | 70.6 |
| [Acrylamide/Acrylic Acid*]-[Bentonite]-[Coloidal Silica] | 2/7.5/7.5 | 46 | 0.046 | 0.035 | 68.8 | 80.4 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid. (*denotes a higher molecular weight version of the aforementioned acrylamide/acrylic acid copolymer).
(3) The copolymer of acrylamide and dimethylamino ethylacrylate methyl chloride quaternary (DMAEA.MCQ) is a very high molecular weight cationic flocculant having 10 mole % of DMAEA.MCQ.
(4) The collodial silica have small particle size and large surface area.
(5) The polyacrylamide is a nonionic homopolymer of polyacrylamide.
(6) The PEO is a liquid suspension of a high molecular weight nonionic polyethylene oxide.

The chemical treatment program of a cationic polymer of DMA/EPI, an anionic copolymer of

TABLE 4

| Chemical Treatment Program | Dosage | Suction Drainage | WW Solids | Ash Wt. | FPAR | FPR |
|---|---|---|---|---|---|---|
| [DMA/EPI]-[Starch]-[Acrylamide/Acrylic Acid*]-[Bentonite] | 0/0/2/20 | 230 | 0.152 | 0.1306 | 41.7 | 67.7 |
| [DMA/EPI]-[Starch]-[Acrylamide/Acrylic Acid*]-[Bentonite] | 0/5/2/20 | 90 | 0.094 | 0.079 | 64.7 | 80.0 |
| [DMA/EPI]-[Starch]-[Acrylamide/Acrylic Acid*]-[Bentonite] | .25/5/2/20 | 61 | 0.084 | 0.0722 | 67.8 | 82.1 |

TABLE 4-continued

| Chemical Treatment Program | Dosage | Suction Drainage | WW Solids | Ash Wt. | FPAR | FPR |
|---|---|---|---|---|---|---|
| [DMA/EPI]-[Solubond]-[Acrylamide/Acrylic Acid*]-[Bentonite] | 0/5/2/20 | 165 | 0.100 | 0.0852 | 62.0 | 78.7 |
| [DMA/EPI]-[Solubond]-[Acrylamide/Acrylic Acid*]-[Bentonite] | .25/5/2/20 | 86 | 0.082 | 0.0676 | 69.8 | 82.6 |
| [DMA/EPI]-[Starch]-[Acrylamide/Acrylic Acid*]-[C.S.] | 0/5/2/20 | 105 | 0.104 | 0.084 | 62.5 | 77.9 |
| [DMA/EPI]-[Starch]-[Acrylamide/Acrylic Acid*]-[C.S.] | .25/5/2/20 | 125 | 0.086 | 0.07 | 68.8 | 81.7 |
| [DMA/EPI]-[Starch]-[Acrylamide/DMAEA.MCQ]-[C.S.] | 0/5/2/20 | 108 | 0.092 | 0.081 | 63.8 | 80.4 |
| [DMA/EPI]-[Starch]-[Acrylamide/DMAEA.MCQ]-[C.S.] | .25/5/2/20 | 260 | 0.080 | 0.0706 | 68.5 | 83.0 |
| [DMA/EPI]-[Starch]-[Acrylamide/DMAEA.MCQ]-[Bentonite] | 0/5/2/20 | 130 | 0.070 | 0.0616 | 72.5 | 85.1 |
| [DMA/EPI]-[Starch]-[Acrylamide/DMAEA.MCQ]-[Bentonite] | .25/5/2/20 | 360 | 0.090 | 0.0764 | 65.9 | 80.9 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid. (*denotes a higher molecular weight version of the aforementioned acrylamide/acrylic acid copolymer).
(3) The copolymer of acrylamide and dimethylamino ethylacrylate methyl chloride quaternary (DMAEA.MCQ) is a very high molecular weight cationic flocculant having 10 mole % of DMAEA.MCQ.

The treatment programs containing the high molecular weight cationic copolymer of acrylamide and DMAEA.MCQ gave very poor suction drainage but excellent ash retention probably due to poor colloid retention. The anionic flocculants were excellent in both suction drainage and ash retention, i.e., the cationic starch was removed more effectively by anionic flocculants. The nonionic flocculants of PEO and polyacrylamide were not effective.

EXAMPLE 3

The treatment programs set forth in Tables 7 and 8 below demonstrate that the deficiency of cationic starch in the paper furnish causes anionic flocculant-based programs to exhibit diminished retention and drainage properties. In Table 7, although the inventor added 10 lbs./ton of fresh cationic starch, it was determined that the program did not have enough cationic starch in the furnish because cationic starch was not added in the size (3:1 ration) nor in the broke during these tests. The paper furnish treated with the various chemical treatment programs included:

Furnish — Synthetic HWK/SWK (60/40) having a Zeta Potential of −3.3 mV.
Filler — Precipitated Calcium Carbonate having a Zeta Potential of +1.8 mV.
HB Solids — 0.46%
HB Ash — 48.5%
System pH — 7.5%
Temp. — 40%

The order of addition was cationic starch, coagulant, flocculant, and inorganic material.

TABLE 7

| Chemical Treatment Program | Dosage (Cationic Starch Added at 10 lbs./ton) | WW Solids | FPR | FPAR |
|---|---|---|---|---|
| Blank | | 0.264 | 42.6 | 14.8 |
| [DMA/EPI]-[Acrylamide/DMAEA.MCQ][Bentonite] | 0/1/10 | 0.046 | 90.0 | 83.4 |
| [DMA/EPI]-[Acrylamide/DMAEA.MCQ][Bentonite] | 0/2/10 | 0.039 | 91.5 | 87.4 |
| [DMA/EPI]-[Acrylamide/DMAEA.MCQ][Bentonite] | 0/0.5/10 | 0.079 | 82.8 | 76.2 |
| [DMA/EPI]-[Acrylamide/DMAEA.MCQ][Bentonite] | 0.5/0.5/10 | 0.076 | 83.5 | 76.2 |
| [DMA/EPI]-[Acrylamide/DMAEA.MCQ][Bentonite] | 0.5/1/10 | 0.049 | 89.6 | 82.1 |
| [DMA/EPI]-[Acrylamide/DMAEA.MCQ][Bentonite] | 0.5/2/10 | 0.029 | 93.7 | 90.6 |
| [DMA/EPI]-[Acrylamide/DMAEA.MCQ][Bentonite] | 0/1/5 | 0.046 | 90.0 | 85.2 |
| [DMA/EPI]-[Acrylamide/DMAEA.MCQ][Bentonite] | 0/1/15 | 0.062 | 86.5 | 80.7 |
| [DMA/EPI]-[Acrylamide/DMAEA.MCQ][Bentonite] | 0/1/20 | 0.071 | 84.6 | 77.1 |
| [DMA/EPI]-[Acrylamide/DMAEA.MCQ][Bentonite] | 0/0.5/0 | 0.201 | 56.3 | 35.4 |
| [DMA/EPI]-[Acrylamide/DMAEA.MCQ][Bentonite] | 0/1/0 | 0.182 | 60.4 | 40.8 |
| [DMA/EPI]-[Acrylamide/DMAEA.MCQ][Bentonite] | 0/2/0 | 0.183 | 60.2 | 44.4 |
| [DMA/EPI]-[Acrylamide/Acrylic Acid][Bentonite] | 0/1/10 | 0.168 | 63.5 | 46.2 |
| [DMA/EPI]-[Acrylamide/Acrylic Acid][Bentonite] | 0/2/10 | 0.101 | 78.0 | 67.7 |
| [DMA/EPI]-[Acrylamide/Acrylic Acid][Bentonite] | 0/0.5/10 | 0.151 | 67.2 | 51.6 |
| [DMA/EPI]-[Acrylamide/Acrylic Acid][Bentonite] | 0.5/0.5/10 | 0.163 | 64.6 | 48.9 |
| [DMA/EPI]-[Acrylamide/Acrylic Acid][Bentonite] | 0.5/1/10 | 0.150 | 67.4 | 52.5 |
| [DMA/EPI]-[Acrylamide/Acrylic Acid][Bentonite] | 0.5/2/10 | 0.138 | 70.0 | 56.5 |
| [DMA/EPI]-[Acrylamide/Acrylic Acid][Bentonite] | 0.5/1/5 | 0.157 | 65.9 | 50.2 |
| [DMA/EPI]-[Acrylamide/Acrylic Acid][Bentonite] | 0.5/1/15 | 0.178 | 61.3 | 44.4 |
| [DMA/EPI]-[Acrylamide/Acrylic Acid][Bentonite] | 0.5/1/20 | 0.185 | 59.8 | 41.2 |
| [DMA/EPI]-[Acrylamide/Acrylic Acid][Bentonite] | 1/1/20 | 0.155 | 66.3 | 50.7 |
| [DMA/EPI]-[Acrylamide/Acrylic Acid][Bentonite] | 2/1/10 | | 64.5 | 64.6 |
| [DMA/EPI]-[Acrylamide/Acrylic Acid][Bentonite] | 4/1/10 | | 77.6 | 77.6 |
| [DMA/EPI]-[Acrylamide/Acrylic Acid][Bentonite] | 0/0.5/0 | | 18.4 | 18.4 |
| [DMA/EPI]-[Acrylamide/Acrylic Acid][Bentonite] | 0/1/0 | | 21.1 | 21.1 |
| [DMA/EPI]-[Acrylamide/Acrylic Acid][Bentonite] | 0/2/0 | | 15.7 | 15.7 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid.
(3) The copolymer of acrylamide and dimethylamino ethylacrylate methyl chloride quaternary (DMAEA.MCQ) is a very high molecular weight cationic flocculant having 10 mole % of DMAEA.MCQ.

TABLE 7

(No Cationic Starch Added)

| Chemical Treatment Program | Dosage | WW Solids | FPR | FPAR |
|---|---|---|---|---|
| Blank | | | 8.5 | 8.5 |
| [DMA/EPI]-[Acrylamide/DMAEA.MCQ][Bentonite] | 0/1/10 | | 66.4 | 66.4 |
| [DMA/EPI]-[Acrylamide/DMAEA.MCQ][Bentonite] | 0.5/1/10 | 0.077 | 83.3 | 75.8 |
| [DMA/EPI]-[Acrylamide/DMAEA.MCQ][Bentonite] | 1/1/10 | 0.061 | 82.4 | 75.3 |
| [DMA/EPI]-[Acrylamide/DMAEA.MCQ][Bentonite] | 2/1/10 | 0.062 | 86.5 | 76.2 |
| [DMA/EPI]-[Acrylamide/Acrylic Acid][Bentonite] | 0/1/10 | 0.230 | 50.0 | 26.0 |
| [DMA/EPI]-[Acrylamide/Acrylic Acid][Bentonite] | 0.5/1/10 | 0.285 | 38.0 | 6.3 |
| [DMA/EPI]-[Acrylamide/Acrylic Acid][Bentonite] | 1/1/10 | 0.229 | 50.2 | 26.4 |
| [DMA/EPI]-[Acrylamide/Acrylic Acid][Bentonite] | 2/1/10 | 0.194 | 57.8 | 38.1 |
| [DMA/EPI]-[Acrylamide/Acrylic Acid][Bentonite] | 4/1/10 | 0.172 | 62.6 | 46.6 |
| [DMA/EPI]-[Acrylamide/Acrylic Acid][Bentonite] | 8/1/10 | 0.103 | 77.6 | 67.7 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid.
(3) The copolymer of acrylamide and dimethylamino ethylacrylate methyl chloride quaternary (DMAEA.MCQ) is a very high molecular weight cationic flocculant having 10 mole % of DMAEA.MCQ.

EXAMPLE 4

Tables 9 and 10 below demonstrate the diminished retention and drainage properties exhibited by anionic flocculant treatment programs when fillers other than precipitated calcium carbonate are added to the paper furnish.

TABLE 9

(Cationic Starch and Calcined Clay)

| Chemical Treatment Program | Dosage | WW Solids | FPR | FPAR |
|---|---|---|---|---|
| Blank | | 0.370 | 30.2 | 8.6 |
| [DMA/EPI]-[Acrylamide/DMAEA.MCQ][Bentonite] | 0/1/10 | 0.359 | 32.3 | 13.3 |
| [DMA/EPI]-[Acrylamide/DMAEA.MCQ][Bentonite] | 0/2/10 | 0.348 | 34.3 | 16.5 |
| [DMA/EPI]-[Acrylamide/DMAEA.MCQ][Bentonite] | 1/1/10 | 0.380 | 28.3 | 7.9 |
| [DMA/EPI]-[Acrylamide/DMAEA.MCQ][Bentonite] | 2/1/10 | 0.361 | 31.9 | 11.9 |
| [DMA/EPI]-[Acrylamide/DMAEA.MCQ][Bentonite] | 4/1/10 | 0.376 | 29.1 | 9.4 |
| [DMA/EPI]-[Acrylamide/DMAEA.MCQ][Bentonite] | 2/2/10 | 0.386 | 27.2 | 8.3 |
| [DMA/EPI]-[Acrylamide/Acrylic Acid][Bentonite] | 0/1/10 | 0.378 | 28.7 | 8.6 |
| [DMA/EPI]-[Acrylamide/Acrylic Acid][Bentonite] | 0/2/10 | 0.374 | 29.4 | 10.1 |
| [DMA/EPI]-[Acrylamide/Acrylic Acid][Bentonite] | 1/1/10 | 0.379 | 28.5 | 8.6 |
| [DMA/EPI]-[Acrylamide/Acrylic Acid][Bentonite] | 2/1/10 | 0.407 | 23.2 | 1.8 |
| [DMA/EPI]-[Acrylamide/Acrylic Acid][Bentonite] | 4/1/10 | 0.408 | 23.0 | 1.1 |
| [DMA/EPI]-[Acrylamide/Acrylic Acid][Bentonite] | 2/2/10 | 0.404 | 23.8 | 4.3 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid.
(3) The copolymer of acrylamide and dimethylamino ethylacrylate methyl chloride quaternary (DMAEA.MCQ) is a very high molecular weight cationic flocculant having 10 mole % of DMAEA.MCQ.

TABLE 10

(Cationic Starch and Titanium Dioxide)

| Chemical Treatment Program | Dosage | WW Solids | FPR | FPAR |
|---|---|---|---|---|
| Blank | | 0.329 | 19.8 | 1.9 |
| [DMA/EPI]-[Acrylamide/DMAEA.MCQ][Bentonite] | 0/1/10 | 0.072 | 82.4 | 75.3 |
| [DMA/EPI]-[Acrylamide/DMAEA.MCQ][Bentonite] | 0/2/10 | 0.053 | 87.1 | 77.6 |
| [DMA/EPI]-[Acrylamide/DMAEA.MCQ][Bentonite] | 1/1/10 | 0.073 | 82.2 | 76.0 |
| [DMA/EPI]-[Acrylamide/DMAEA.MCQ][Bentonite] | 2/1/10 | 0.049 | 88.0 | 78.0 |
| [DMA/EPI]-[Acrylamide/DMAEA.MCQ][Bentonite] | 4/1/10 | 0.058 | 85.9 | 78.7 |
| [DMA/EPI]-[Acrylamide/DMAEA.MCQ][Bentonite] | 2/2/10 | 0.030 | 92.7 | 86.7 |
| [DMA/EPI]-[Acrylamide/Acrylic Acid][Bentonite] | 0/1/10 | 0.344 | 16.1 | 1.1 |
| [DMA/EPI]-[Acrylamide/Acrylic Acid][Bentonite] | 0/2/10 | 0.266 | 35.1 | 21.1 |
| [DMA/EPI]-[Acrylamide/Acrylic Acid][Bentonite] | 1/1/10 | 0.314 | 23.4 | 6.2 |
| [DMA/EPI]-[Acrylamide/Acrylic Acid][Bentonite] | 2/1/10 | 0.296 | 27.8 | 12.4 |
| [DMA/EPI]-[Acrylamide/Acrylic Acid][Bentonite] | 4/1/10 | 0.209 | 49.0 | 38.5 |
| [DMA/EPI]-[Acrylamide/Acrylic Acid][Bentonite] | 6/1/10 | 0.245 | 40.2 | 29.6 |
| [DMA/EPI]-[Acrylamide/Acrylic Acid][Bentonite] | 2/2/10 | 0.240 | 41.5 | 29.2 |

Notes:
(1) DMA/EPI is a low molecular weight cationic polymer of dimethylamine and epichlorohydrin having a molar ratio of 0.85:1 and a molecular weight of 50,000.
(2) The acrylamide/acrylic acid copolymer is a high molecular weight anionic flocculant comprising 30 mole % acrylic acid.
(3) The copolymer of acrylamide and dimethylamino ethylacrylate methyl chloride quaternary (DMAEA.MCQ) is a very high molecular weight cationic flocculant having 10 mole % of DMAEA.MCQ.

Based upon the retention data gathered during the above experiments, the cationic coagulant/anionic flocculant/bentonite treatment program according to the present invention exhibited superior retention and drainage properties when used to treat cellulosic suspensions comprising fibers, precipitated calcium carbonate, and cationic starch. In direct comparison tests conducted on such suspensions, the cationic coagulant-/anionic flocculant/bentonite treatment program was superior to conventional cationic coagulant/cationic flocculant/bentonite treatment programs. It was also determined during the aforementioned experiments that nonionic flocculants, such as polyethylene oxide and polyacrylamide had little or no impact on ash retention.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. A process in which fine paper is made by forming an aqueous cellulosic suspension having a pH in the range between about 6.8 to about 9.0, said cellulosic suspension comprising fibers, a precipitated calcium carbonate filler and a cationic starch strengthening agent, passing the suspension through one or more shear stages, draining the suspension to form a sheet and drying the sheet, wherein a cationic coagulant having a molecular weight in the range between about 2,000 to about 500,000 is added to said suspension in an amount between about 0.001% to about 0.5%, based on the dry weight of said suspension, prior to any of said shear stages, an anionic flocculant having a molecular weight of at least 5000,000 is added to said suspension in an amount between about 0.001% to about 0.8%, based on the dry weight of said suspension, after said coagulant but before any of said shear stages, and an inorganic material selected from the group consisting of: bentonite and colloidal silica, is added to said suspension after at least one of said shear stages.

2. The process according to claim 1 wherein said coagulant has a molecular weight in the range between about 10,000 to about 500,000.

3. The process according to claim 1 wherein said coagulant is added to a thick stock of said cellulosic suspension and said anionic flocculant is added to a thin stock of said cellulosic suspension, said thin stock is a dilute aqueous suspension of said thick stock.

4. The process according to claim 1 wherein said coagulant is cationic and selected from the group consisting of: polyethylene imine, polyamines, polycyandiamide formaldehyde polymers, amphoteric polymers, diallyl dimethyl ammonium chloride polymers, diallylaminoalkyl (meth) acrylate polymers, and dialkylaminoalkyl (meth) acrylamide polymers, a copolymer of acrylamide and diallyl dimethyl ammonium chloride, a copolymer of acrylamide and diallyaminoalkyl (meth) acrylates, a copolymer of acrylamide and dialkylaminoalkyl (meth) acrylamides, and a polymer of dimethylamine and epichlorohydrin.

5. The process according to claim 1 wherein said anionic flocculant has a degree of anionic substitution of at least 0.01.

6. The process according to claim 1 wherein said high molecular weight anionic flocculants are selected from the group consisting of: copolymers of acrylamide and acrylic acid, and copolymers of acrylamide and acrylamido-2-methyl propyl sulfonate.

7. The process according to claim 4 wherein said coagulant is a polymer of dimethylamine and epichlorohydrin having a molecular weight of about 50,000.

8. The process according to claim 6 wherein said anionic flocculant is an anionic copolymer of acrylamide and acrylic acid having 30 mole % of acrylic acid.

9. The process according to claim 1 wherein said inorganic material is bentonite which is added in an amount of from about 0.03 to about 1%, based on the dry weight of said suspension.

10. The process according to claim 1 wherein said pH of said cellulosic suspension is in the range between about 7.2 to about 9.0.

* * * * *